US011746578B2

(12) United States Patent
Kennedy

(10) Patent No.: US 11,746,578 B2
(45) Date of Patent: Sep. 5, 2023

(54) DOOR SECURING APPARATUS

(71) Applicant: Paul A. Kennedy, Ft. Wright, KY (US)

(72) Inventor: Paul A. Kennedy, Ft. Wright, KY (US)

( * ) Notice: Subject to any disclaimer, the term of this patent is extended or adjusted under 35 U.S.C. 154(b) by 0 days.

(21) Appl. No.: 17/863,723

(22) Filed: Jul. 13, 2022

(65) Prior Publication Data

US 2023/0020382 A1 Jan. 19, 2023

Related U.S. Application Data

(60) Provisional application No. 63/222,865, filed on Jul. 16, 2021.

(51) Int. Cl.
*E05C 17/18* (2006.01)

(52) U.S. Cl.
CPC ..... *E05C 17/18* (2013.01)

(58) Field of Classification Search
CPC ..... E05C 17/18; E05C 17/00; E05C 17/02; E05C 17/04; E05C 17/045; E05C 17/12; E05C 17/20; E05C 17/22; E05C 17/24; E05C 17/28; E05C 19/18; E05C 19/182; E05C 19/184; E05C 19/188; E05B 65/0014; E05B 63/0052; Y10S 292/65; Y10S 292/53; Y10S 292/54; Y10T 70/5164; Y10T 70/5168; Y10T 292/20; Y10T 292/228; Y10T 292/34; Y10T 292/37; Y10T 292/373; Y10T 292/376; Y10T 292/65; Y10T 292/67; Y10T 292/71; Y10T 292/73
See application file for complete search history.

(56) References Cited

U.S. PATENT DOCUMENTS 826,538 A * 7/1906 Carter ..... E05C 19/182 292/292
1,033,255 A * 7/1912 Lochhead ..... E05C 19/182 292/296
1,046,102 A * 12/1912 Noel ..... E05C 19/182 292/293
1,055,830 A * 3/1913 Tafe ..... E05C 19/182 292/291
1,176,859 A * 3/1916 Sautter ..... E05C 19/182 292/298
2,161,673 A * 6/1939 Hammond ..... E05C 19/182 292/290
3,039,806 A * 6/1962 Rice ..... E05C 19/182 292/293
3,187,372 A * 6/1965 Parsons ..... E05F 5/06 16/86 A (Continued)

FOREIGN PATENT DOCUMENTS

JP 5231439 B2 * 7/2013 ..... E05B 17/20

OTHER PUBLICATIONS

Int'l. Search Report and Written Opinion, Int'. Searching Authority, Application No. PCT/US22/36962, dated Oct. 18, 2022, 13 pages.

*Primary Examiner* — Kristina R Fulton
*Assistant Examiner* — Tal Saif
(74) *Attorney, Agent, or Firm* — Frost Brown Todd LLP; Vance V. VanDrake III

(57) ABSTRACT

Disclosed is a door securing apparatus. The door securing apparatus includes a base member, a pivoting arm extension, and a door-contacting member that act in concert to secure a door in a closed position.

17 Claims, 6 Drawing Sheets

(56) References Cited

U.S. PATENT DOCUMENTS 3,425,386 A * 2/1969 Campbell ..... G08B 13/08 116/87
3,494,653 A * 2/1970 Steele ..... E05C 19/182 292/291
3,913,171 A * 10/1975 Reid ..... E05D 11/06 16/342
3,989,291 A * 11/1976 Hucknall ..... E05C 17/20 292/262
4,013,311 A * 3/1977 Prezioso ..... E05C 19/003 292/264
4,082,335 A * 4/1978 Smith ..... E05C 19/182 292/291
4,174,861 A * 11/1979 Drake ..... E05C 17/166 70/93
4,290,635 A * 9/1981 McKenzie ..... E05C 19/182 292/290
4,387,919 A * 6/1983 Quaintance ..... E05C 19/182 292/296
4,482,177 A * 11/1984 Nagy ..... E05C 17/365 292/264
4,627,651 A * 12/1986 Grimbly ..... E05C 19/184 292/341.15
4,711,479 A * 12/1987 Grandinetti ..... E05C 17/28 292/272
4,763,938 A * 8/1988 Schlanger ..... E05C 19/182 292/290
4,846,514 A * 7/1989 Flynn ..... E05C 17/166 292/268
4,865,369 A * 9/1989 Parker ..... E05C 19/184 292/291
4,951,982 A * 8/1990 Sorkilmo ..... E05B 13/002 292/343
5,265,922 A * 11/1993 Falcone ..... E05C 19/184 292/288
5,327,632 A * 7/1994 Moore ..... E05B 13/002 70/416
5,489,129 A * 2/1996 Shepherd ..... E05C 19/18 292/67
5,566,993 A * 10/1996 Olivas ..... E05C 19/182 292/288
5,605,365 A * 2/1997 George ..... E05C 17/166 292/DIG. 53
6,409,236 B1 * 6/2002 Steele ..... E05C 19/182 292/291
8,464,396 B2 * 6/2013 Westby ..... E05D 11/0018 16/386
8,661,618 B2 * 3/2014 Jablonski ..... E05D 3/02 16/326
2007/0107479 A1 5/2007 Robertson
2014/0306464 A1 10/2014 Lowe
2020/0291698 A1 9/2020 Kemp

* cited by examiner

DOOR SECURING APPARATUS

REFERENCE TO RELATED APPLICATION

This application claims priority of U.S. provisional patent application Ser. No. 63/222,865, entitled DOOR SECURING APPARATUS, filed Jul. 16, 2021, and hereby incorporates this provisional patent application by reference herein in its entirety.

TECHNICAL FIELD

Embodiments of the technology relate, in general, to systems, apparatuses and methods for securing a hinged door in a closed position.

BACKGROUND

Often persons in a room desire to prevent unwanted or unauthorized entry into the room. Traditional door locks can be insecure and easily defeated.

DETAILED DESCRIPTION

Figure 1:
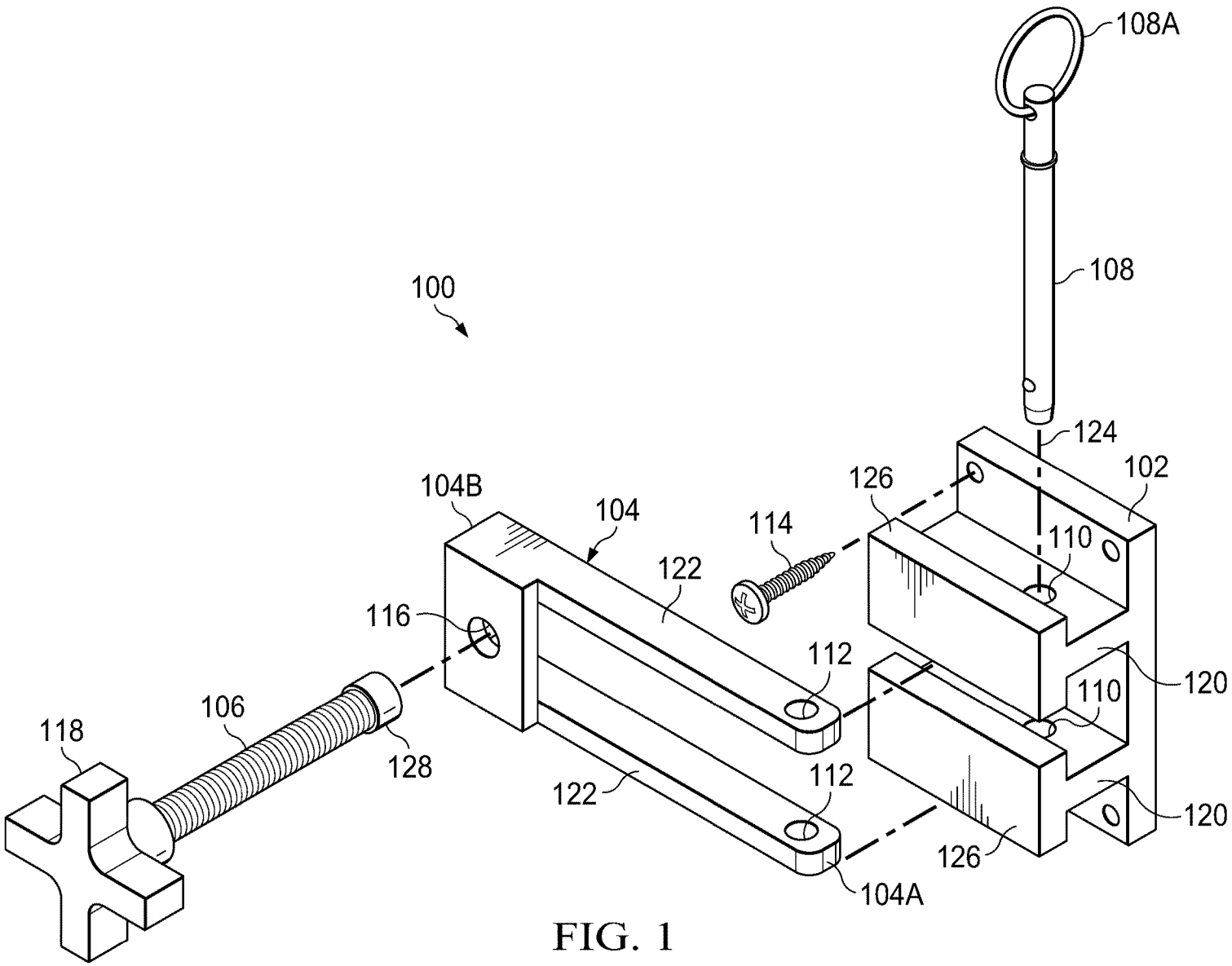
FIG. 1 is an exploded perspective view of an example system and apparatus for securing a door.

Certain embodiments are hereinafter described in detail in connection with the views and examples of FIGS. 1-6.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Figure 2:
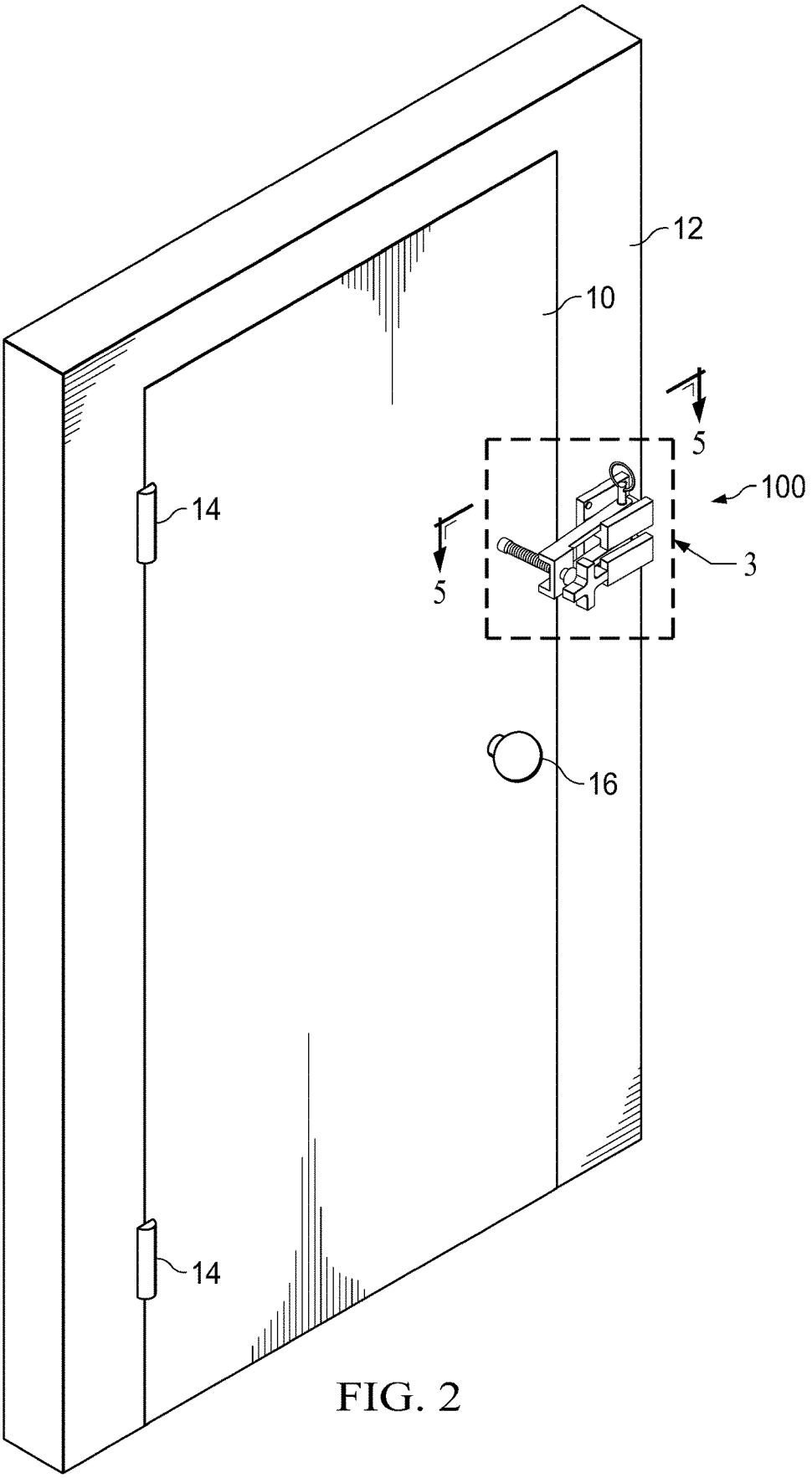
FIG. 2 is a perspective view of a door secured by a system and apparatus for securing a door.
Figure 3:
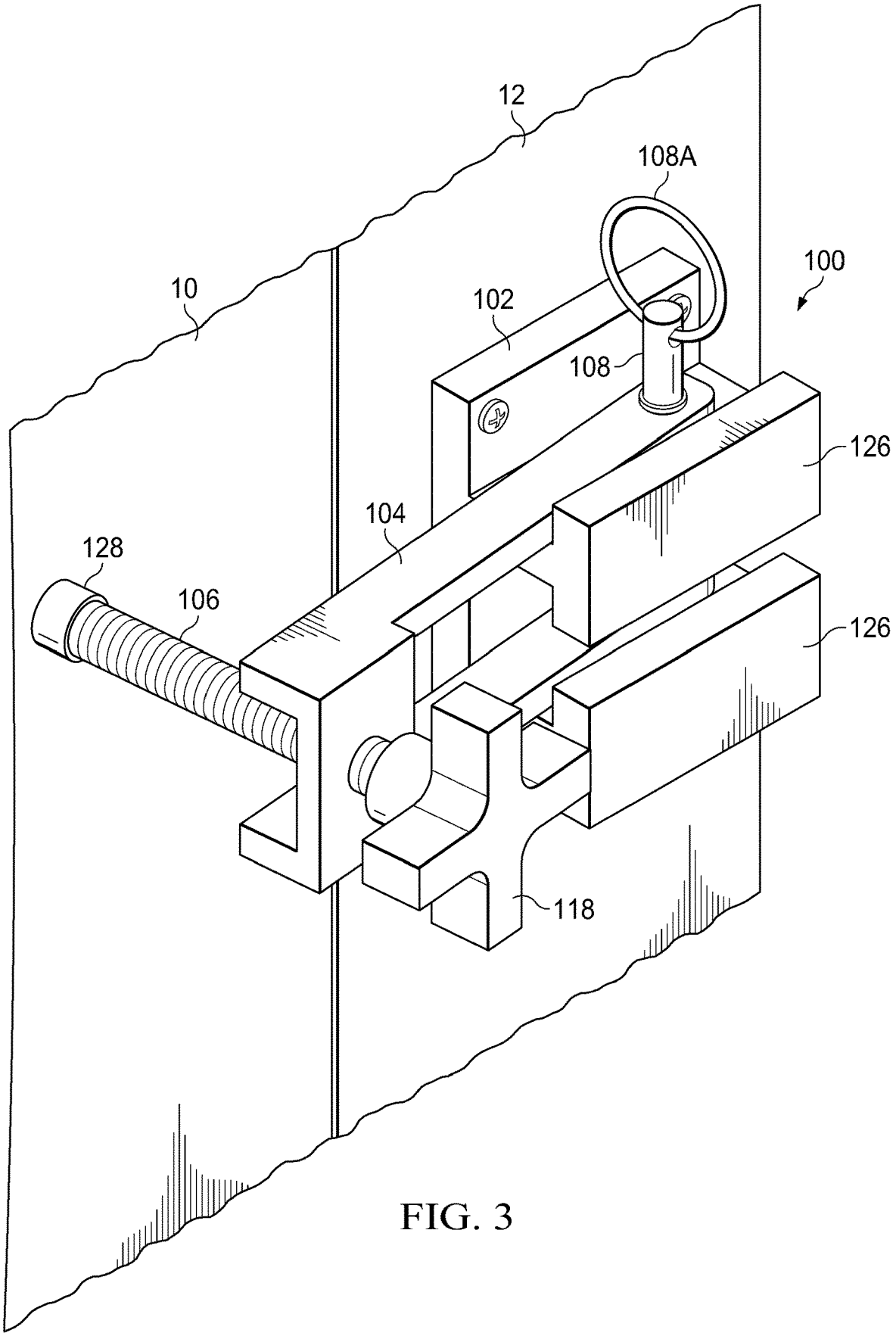
FIG. 3 is an enlarged perspective view of a system and apparatus for securing a door.

Referring to FIGS. 1-3, there is shown an example embodiment of a door securing apparatus 100 of the present disclosure. The door securing apparatus 100 is shown in an exploded view in FIG. 1. The door securing apparatus 100 is shown in a representative method of mounting in FIG. 2. The door securing apparatus 100 is shown in FIG. 3 in a mounted, in-use, configuration.

The door securing apparatus 100 has a mounting member 102 that can be affixed to a stationary surface, such as a wall, or a door frame 12, as depicted in FIG. 2. The mounting member 102 can be affixed to the stationary surface suitably in proximity to a door 10 to be secured by the method and system as described herein. The mounting member 102 has at least one mounting extension 120 that can extend generally perpendicularly to the wall or door frame, and which defines at least one through-opening, such as a first pivot-axis through-hole 110, two of which are shown in the example embodiment of FIG. 1, being in alignment with a pivot axis 124. The mounting member 102 can be affixed to the wall or door frame 12 by a wall fastener 114, which can be a screw, nail, clamp, adhesive, bolt, and the like. In an embodiment, the wall fastener 114 can be a screw, and a plurality of screws can be used to affix the mounting member 102 to a wall or door frame 12.

The door securing apparatus 100 has a pivoting arm extension 104 that can be affixed at a proximal portion 104A to the mounting member 102. In the example embodiment, the pivoting arm extension 104 has two generally linearly extending connection arms 122, each having at the proximal portion 104A a second pivot-axis opening 112. As can be understood from the description herein, the pivoting arm extension 104 can be positioned relative to the mounting member 102 such that the second pivot-axis opening 112 of each of the connection arms 122 can be in alignment with the pivot axis 124. When aligned, a pivot-securing member 108 can fix the first pivot-axis through-hole(s) 110 and the second pivot-axis through-hole(s) 112 in alignment with the pivot axis 124. In the illustrated embodiment, the pivot-securing member 108 can be a rod or pin suitably sized and shaped to be inserted into and through the first pivot-axis through-hole(s) 110 and the second pivot-axis through-hole (s) 112. When the pivot-securing member 108 is in operable position, as shown in FIG. 3, the pivoting arm extension 104 is secured to the mounting member 102 in a moveable relationship, being pivotal about the pivot axis 124. In an embodiment, the pivot-securing member 108 can have a graspable removal member 108A, such as a finger ring, as shown.

A door-contacting member 106 can adjustably secured to the pivoting arm extension 104 near a distal portion 104B. In the illustrated embodiment, the door-contacting member 106 is a threaded member that is threaded into a mating threaded opening 116 at the distal portion 104B of the pivoting arm extension 104. A threaded door-contacting member 106 can have a knob 118 at a first end, the knob 118 being suitably sized and shaped for hand-turning the door-contacting member to thread it in to or out of the mating threaded opening 116. A relatively soft tip 128 can be disposed on a second end of the door-contacting member 106 to minimize marring the finish of the door 10 during use. The door-contacting member 106 can have a sufficient length such that the relatively soft tip 128 can be suitably pressed on to the surface of the door 10 during use of the door securing apparatus 100.

The range of pivoting motion of the pivoting arm extension 104 can be limited in a first pivoting direction by a first portion of the mounting member 102, and in a second pivoting direction by a pivot-stop member 126, which can be second portion of the mounting member 102, such as a suitable surface in spaced relationship from the wall or door frame. In the illustrated embodiment, the pivot-stop member 126 is a T-shaped extension of the mounting extension 120. Further, the interior spacing between the two connection arms 122 can be sufficient to clear the broad face of at least one of the T-shaped extensions of pivot-stop member 126, as shown in 1. Once cleared, the two connection arms 122 can be translated in a direction parallel to the pivot axis 124 such that they reside interiorly of the T-shaped extension, as shown in FIG. 3. In this manner the pivoting arm extension can be lifted and rotated clear of the door to permit the door to open when desired, without removing the pivot-securing member 108.

Continuing to refer to FIG. 3 there is illustrated a method of use of the system and apparatus of the door securing apparatus 100. As shown in FIG. 3, pivoting arm extensions 104 can each be disposed in the mounting member 102 such that pivoting movement is constrained in one direction by the first portion of the mounting member 102, and the second portion of the mounting member 102, the second portion being the pivot-stop member 126. In an embodiment, the first portion of the mounting member 102 can be the portion in direct mounted contact with the wall or door frame 12. The connection arms 122 can reside, therefore, between two generally parallel surfaces that are substantially immoveable relative to one other. In operation, the door 10 to be secured can be closed sufficiently for the pivoting arm extension 104 to be secured by the pivot-securing member 108 with the distal edge of the door being between the arm extensions and the edge of the door frame 12. When the door securing apparatus 100 is suitably mounted on a wall or door frame 12, a door 10 can be secured in a closed relationship. As the door-contacting member 106 is rotated by turning the knob 118, it advances in a direction toward the door (as indicated by the arrow A1 in the embodiment illustrated in FIG. 5) and contacts the door 10. Once the door-contacting member 106 contacts the door 10, further advancement of the door-contacting member 106 tends to provide a force on the door suitable for causing the door 10 to move into contact with a portion of the door frame 12, for example at a compressive interface 130 (as depicted in the embodiment illustrated in FIG. 5). Further advancement of the door-contacting member 106 tends to force the pivoting arm extension 104 in the direction away from the door (e.g., in the direction of arrow A2 as depicted in the embodiment illustrated in FIG. 5) as it pivots about the pivot axis 124. Pivoting (e.g., in the direction of arrow A2 as depicted in the embodiment illustrated in FIG. 5) is limited by the pivot-stop member 126. When the pivoting arm extension 104 contacts the pivot-stop member 126, (such as at the contact portion 132 as depicted in the embodiment illustrated in FIG. 5), further rotation about pivot axis 124 is prevented. As can be understood, further advancement of door-contacting member 106 causes more pressure at compressive interface 130 (as depicted in the embodiment illustrated in FIG. 5).

The force of the door-contacting member 106 applied to the door 10 prevents the door from opening. To open the door 10, the door securing apparatus 100 can be disabled by removing the pivot-securing member 108 and subsequently removing the pivoting arm extension 104.

Figure 4:
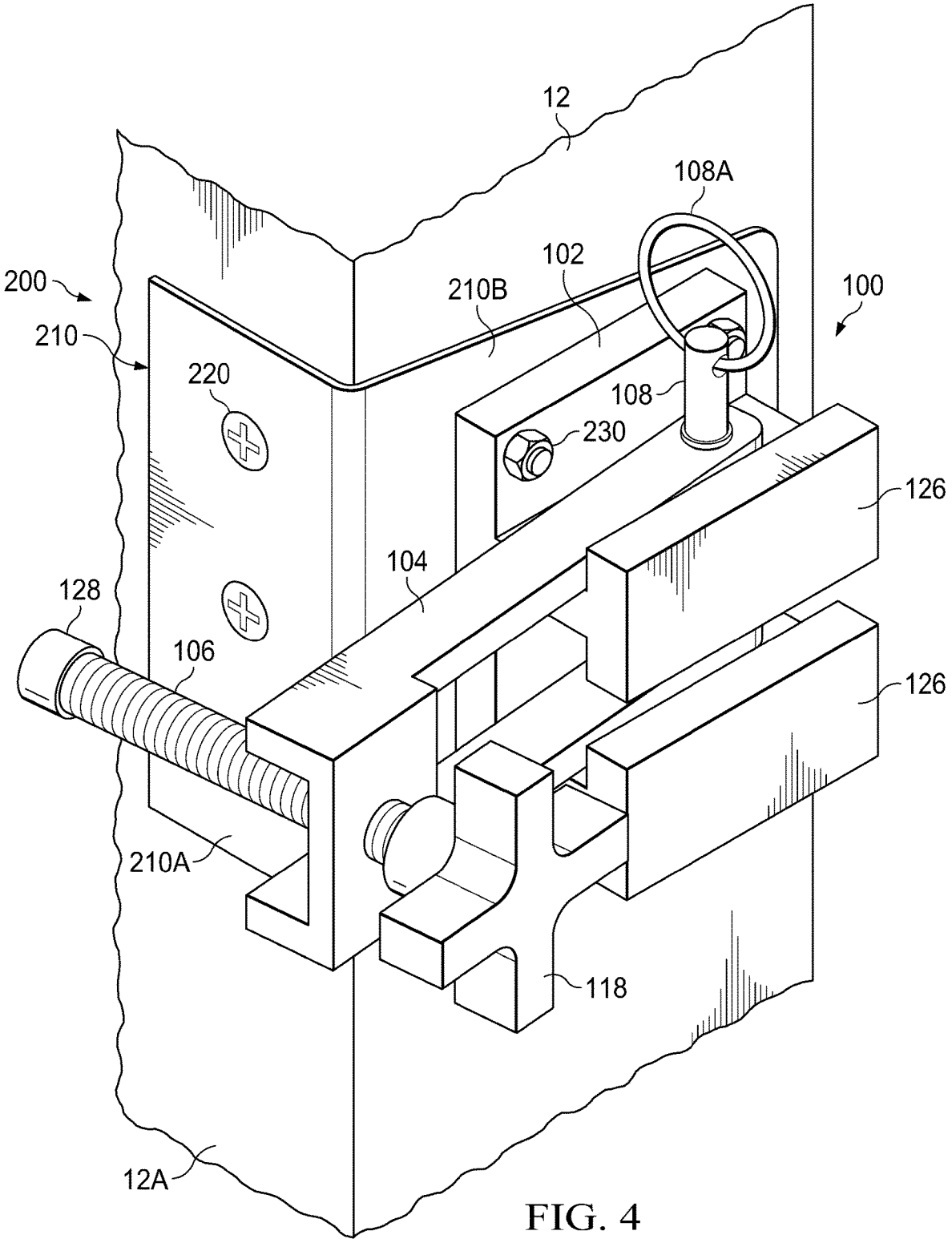
FIG. 4 is a perspective view of an example system and apparatus for securing a door.
Figure 5:
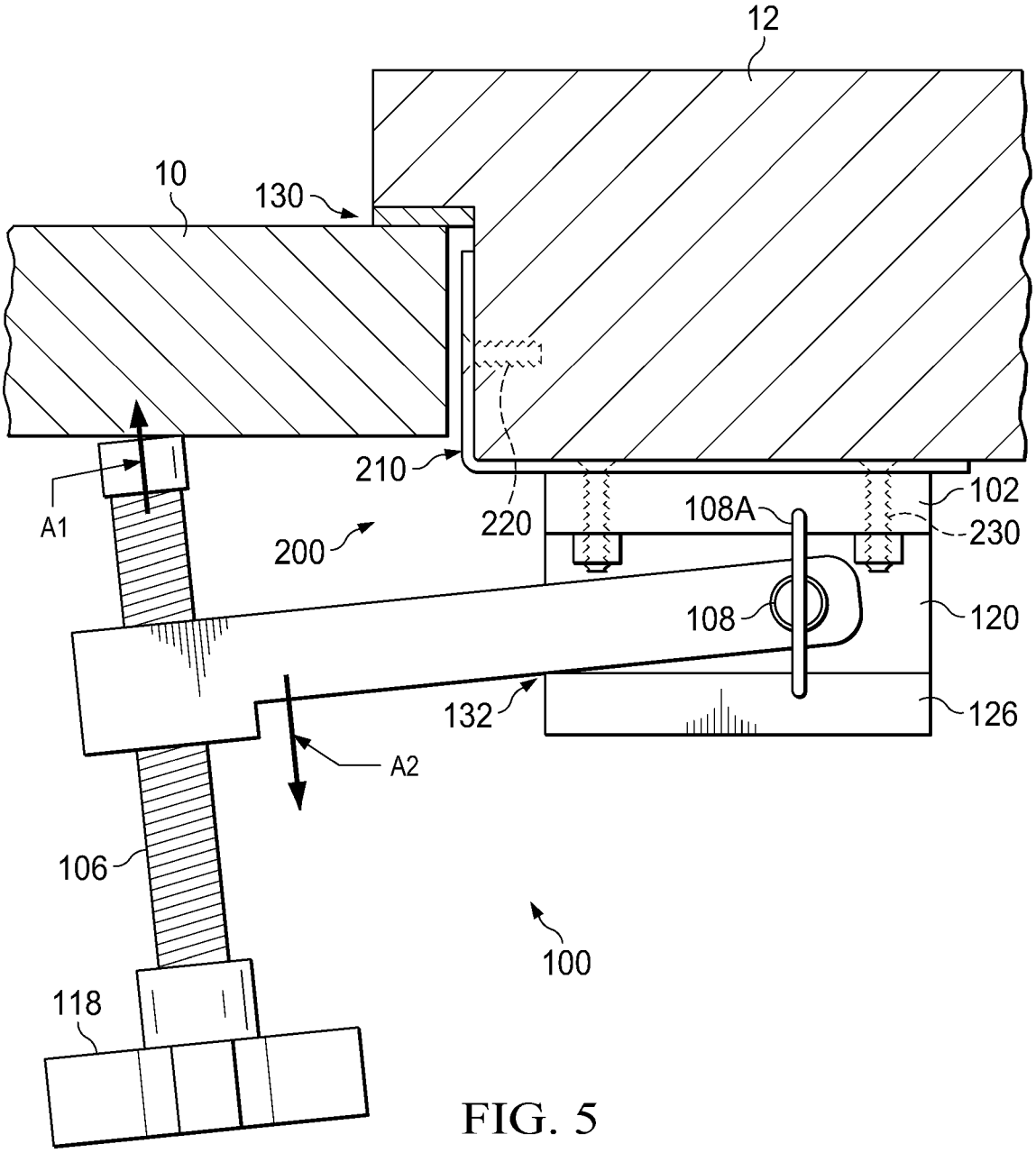
FIG. 5 is a cross sectional view of Section 5-5 in FIG. 2.
Figure 6:
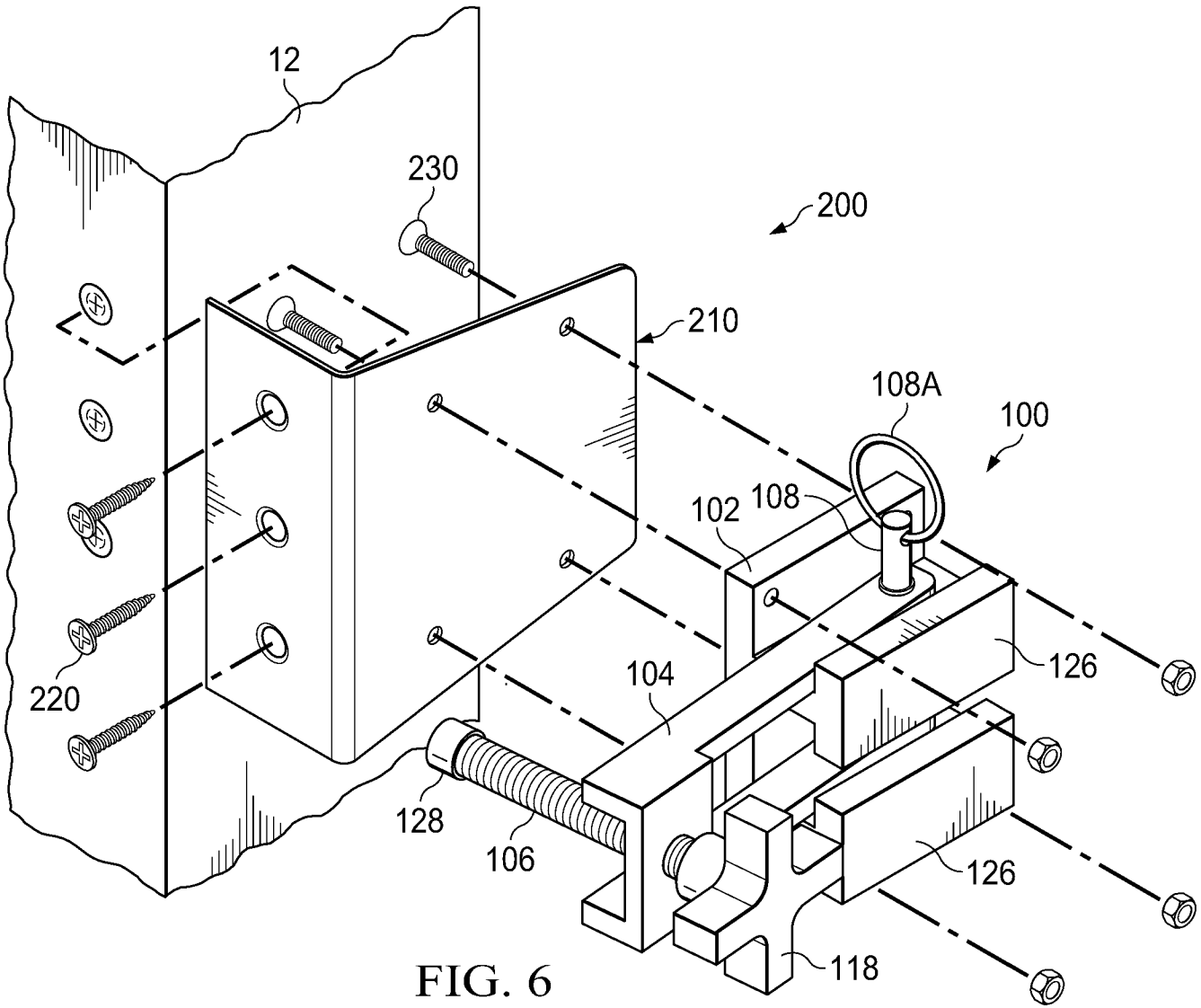
FIG. 6 is an exploded perspective view of an example system and apparatus for securing a door.

Referring to FIGS. 4-6, there is shown an example embodiment of a door securing apparatus 200 of the present disclosure. The door securing apparatus 200 is shown in FIG. 4 in a mounted configuration. The door securing apparatus 200 is shown in cross-section in a representative method of use in FIG. 5. The door securing apparatus 200 is shown in an exploded view in FIG. 6.

The door securing apparatus 200 incorporates and can include all the features of the door securing apparatus 100, as discussed above. However, rather than the mounting member 102 being affixed to a stationary surface, such as a wall, or a door frame 12, as depicted in FIG. 2, the mounting member 102 can be mounted to a mounting plate 210, and the mounting plate 210 can be affixed to a door frame 12 of a door 10. The mounting plate 210 can be a generally L-shaped plate having a first leg 210A and a second leg 210B. In use, as depicted in FIGS. 4 and 5, the first leg 210A can be mounted to an inside surface of a door jamb casing 12A, such that door jamb mounting members 220, such as screws, nails, bolts, and the like, can be affixed to a portion of the doorway that are not visible, and do not mar the appearance of the door frame.

The mounting member 102 can be affixed to the mounting plate 210 by, for example, one or more mounting plate fastening members 230, which can be screws, bolts, nuts, and the like. The entire assembly can then be affixed suitably in proximity to a door 10 to be secured by the method and system as described herein.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

What is claimed is:

1. A door securement apparatus, comprising:

a mounting member, the mounting member comprising a mounting member first portion having a relatively flat surface adapted for affixing to a stationary surface in suitable proximity to a door to be secured;

at least one mounting extension, the at least one mounting extension extending perpendicularly from the mounting member first portion, the at least one mounting extension defining at least one mounting extension opening, the at least one mounting extension opening defining a pivot axis;

a pivoting arm having at least one connection arm, each of the at least one connection arm having a proximal portion and a distal portion, each of the at least one connection arm defining a pivoting arm opening at the proximal portion, wherein the pivoting arm is pivotally affixed to the at least one mounting extension by a pivot-securing member that extends through the at least one mounting extension opening and the pivoting arm opening at the pivot axis;

a pivot-stop member, the pivot-stop member being generally parallel to and spaced apart from the mounting member first portion, the pivot-stop member limiting movement of the pivoting arm extension in a first direction, and wherein the pivot-stop member is a T-shaped extension of the mounting member first portion; and an internally threaded opening at the distal portion of the at least one connection arm and an externally threaded door-contacting member being threaded into the internally threaded opening.

2. The door securement apparatus of claim 1, wherein the mounting extension opening is a pivot-axis through-hole.

3. The door securement apparatus of claim 1, wherein the door securement apparatus comprises two mounting extensions.

4. The door securement apparatus of claim 1, wherein the pivot-securing member is a pin and comprises a graspable removal member.

5. The door securement apparatus of claim 1, wherein the externally threaded door-contacting member has a suitable length to be urged into a closed door during operation of the door securement apparatus.

6. The door securement apparatus of claim 1, wherein the externally threaded door-contacting member further comprises a first end comprising a knob and a second end comprising a soft member.

7. A door securement apparatus, comprising:

a mounting plate, the mounting plate having a first leg and a second leg, the first leg being mountable to an inside surface of a door jamb casing, and the second leg being adjacent a stationary surface;

a mounting member, the mounting member comprising a mounting member first portion having a relatively flat surface adapted for affixing to the mounting plate;

at least one mounting extension, the at least one mounting extension extending perpendicularly from the mounting member first portion, the at least one mounting extension defining at least one mounting extension opening, the at least one mounting extension opening defining a pivot axis;

a pivoting arm having at least one linearly extending connection arm, each of the at least one linearly extending connection arm having a proximal portion and a distal portion, each of the at least one linearly extending connection arm defining a pivoting arm opening at the proximal portion, wherein the pivoting arm is pivotally affixed to the at least one mounting extension by a pivot-securing member that extends through the at least one mounting extension opening and the pivoting arm opening along the pivot axis;

a pivot-stop member, the pivot-stop member being generally parallel to and spaced apart from the mounting member first portion, the pivot-stop member limiting movement of the pivoting arm extension in a first direction, and wherein the pivot-stop member is a T-shaped extension of the mounting member first portion; and an internally threaded opening at the distal portion of the at least one linearly extending connection arm and an externally threaded door-contacting member being threaded into the internally threaded opening.

8. The door securement apparatus of claim 7, wherein the mounting extension opening is a pivot-axis through-hole.

9. The door securement apparatus of claim 7, wherein the door securement apparatus comprises two mounting extensions.

10. The door securement apparatus of claim 7, wherein the pivot-securing member is a pin and comprises a graspable removal member.

11. The door securement apparatus of claim 7, wherein the externally threaded door-contacting member has a suitable length to be urged into a closed door during operation of the door securement apparatus.

12. The door securement apparatus of claim 7, wherein the externally threaded door-contacting member further comprises a first end comprising a knob and a second end comprising a soft member.

13. A door securement apparatus, comprising:

a mounting member, the mounting member comprising a mounting member first portion having a relatively flat surface adapted for affixing to a stationary surface in suitable proximity to a door to be secured;

a first mounting extension and a second mounting extension, each of the first and second mounting extensions extending perpendicularly from the mounting member first portion, each of the first and second mounting extensions defining at least one mounting extension opening, the at least one mounting extension opening defining a pivot axis;

a pivoting arm having a first pivoting connection arm and a second pivoting connection arm, each of the connection arms having a proximal portion and a distal portion, each of the connection arms defining a pivoting arm opening at the proximal portion, wherein the first and second pivoting connection arms are each pivotally affixed to the first and second mounting extensions, respectively, by a pivot-securing member that extends through the at least one mounting extension opening and the first and second pivoting arm openings along the pivot axis;

a first pivot-stop member and a second pivot stop member, each of the first and second pivot-stop members being generally parallel to and spaced apart from the mounting member first portion, the first and second pivot-stop members limiting movement of the first and second pivoting connection arms, respectively, in a first direction, and wherein the first and second pivot-stop members are each a T-shaped extension of the mounting member first portion; and an internally threaded opening at a distal portion of the first pivoting arm and an externally threaded door-contacting member being threaded into the internally threaded opening.

14. The door securement apparatus of claim 13, wherein the pivot-securing member is a pin and comprises a graspable removal member.

15. The door securement apparatus of claim 13, wherein the externally threaded door-contacting member has a suitable length to be urged into a closed door during operation of the door securement apparatus.

16. The door securement apparatus of claim 13, wherein the externally threaded door-contacting member further comprises a first end comprising a knob and a second end comprising a soft member.

17. The door securement apparatus of claim 13, further comprising a mounting plate, the mounting plate having a first leg and a second leg, the first leg being mountable to an inside surface of a door jamb casing, and the second leg being adjacent the stationary surface; and wherein the mounting member is joined to the mounting plate.

* * * * *